US009230499B2

(12) United States Patent
Cheng et al.

(10) Patent No.: US 9,230,499 B2
(45) Date of Patent: Jan. 5, 2016

(54) SOURCE DRIVING APPARATUS WITH POWER SAVING MECHANISM AND FLAT PANEL DISPLAY USING THE SAME

(71) Applicants: Yang-Cheng Cheng, Hsinchu (TW); Chien-Chun Huang, Hsinchu (TW)

(72) Inventors: Yang-Cheng Cheng, Hsinchu (TW); Chien-Chun Huang, Hsinchu (TW)

(73) Assignee: FocalTech Systems Co., Ltd., Hsinchu (TW)

( * ) Notice: Subject to any disclaimer, the term of this patent is extended or adjusted under 35 U.S.C. 154(b) by 392 days.

(21) Appl. No.: 13/957,443

(22) Filed: Aug. 2, 2013

(65) Prior Publication Data

US 2014/0104261 A1 Apr. 17, 2014

(30) Foreign Application Priority Data

Oct. 12, 2012 (TW) ..... 101137768 A

(51) Int. Cl.
*G09G 3/36* (2006.01)

(52) U.S. Cl.
CPC ..... *G09G 3/3696* (2013.01); *G09G 3/3614* (2013.01); *G09G 3/3688* (2013.01); *G09G 2330/023* (2013.01)

(58) Field of Classification Search
CPC . G09G 3/3696; G09G 3/3688; G09G 3/3614; G09G 2330/023
See application file for complete search history.

(56) References Cited

U.S. PATENT DOCUMENTS

| | | | | |
|---|---|---|---|---|
| 6,650,310 | B2 | 11/2003 | Yoon | |
| 7,701,474 | B2 * | 4/2010 | Hashimoto | G09G 3/3607 345/690 |
| RE42,993 | E * | 12/2011 | Nitta | G09G 3/2011 345/100 |
| 8,188,964 | B2 * | 5/2012 | Tsuruta | G09G 3/3696 345/100 |
| 2011/0134093 | A1 * | 6/2011 | Chen | G09G 3/3685 345/211 |
| 2011/0157140 | A1 * | 6/2011 | Piasecki | G09G 3/18 345/212 |

* cited by examiner

*Primary Examiner* — Andrew Sasinowski
(74) *Attorney, Agent, or Firm* — Jianq Chyun IP Office

(57) ABSTRACT

A source driving apparatus with power saving mechanism and a flat panel display using the same are provided. The source driving apparatus includes an output buffer stage and a power-saving circuit. The output buffer stage operates under a dual power, and has a positive and negative output channels respectively coupled to two adjacent data lines in a display panel. Moreover, the power-saving circuit is coupled between the output buffer stage and the display panel. The power-saving circuit collects charges from an equivalent load capacitor of each data line, before the output buffer stage drives the two adjacent data lines through the positive and negative output channels. The power-saving circuit charges one of a positive supply and a negative supply of the dual power in response to the collected charges, during the output buffer stage drives the two adjacent data lines through the positive and negative output channels.

20 Claims, 4 Drawing Sheets

SOURCE DRIVING APPARATUS WITH POWER SAVING MECHANISM AND FLAT PANEL DISPLAY USING THE SAME

CROSS-REFERENCE TO RELATED APPLICATION

This application claims the priority benefit of Taiwan application serial no. 101137768, filed on Oct. 12, 2012. The entirety of the above-mentioned patent application is hereby incorporated by reference herein and made a part of this specification.

TECHNICAL FIELD

The invention relates to a flat panel display technique, and more particularly, to a source driving apparatus with power saving mechanism and a flat panel display using the same.

BACKGROUND

In recent years, with great advance in the semiconductor technique, portable electronic devices and flat panel display apparatuses have been rapidly developed. Among various types of flat panel display, liquid crystal displays (LCDs) have gradually become the mainstream display products due to the advantages such as low operating voltage, free of harmful radiation, light-weight, small, compact size and so on.

In practice, the driving method such as a dot polarity inversion, a column polarity inversion, a row polarity inversion or a frame polarity inversion may be adopted to drive a liquid crystal display panel, in order to prevent liquid crystal molecules of each pixel within the liquid crystal display panel being deteriorated.

For the driving method of the dot polarity inversion with a preferable display quality, the driving polarities of any two adjacent pixels are opposite in the liquid crystal display panel. Therefore, a source driving apparatus configured to drive each of the data lines within the liquid crystal display panel has to perform the polarity inversion several times. Accordingly, under the condition of the source driving apparatus without power saving mechanism, the source driving apparatus overall may generate a considerable power consumption.

SUMMARY

Accordingly, in order to solve the issues/problems mentioned in the background, an exemplary embodiment of the invention provides a source driving apparatus with power saving mechanism, which at least includes an output buffer stage and a power-saving circuit, wherein the output buffer stage has a positive output channel and a negative output channel respectively coupled to a first data line and a second data line of a display panel, and the output buffer stage operates under a positive supply and a negative supply. The power-saving circuit is coupled between the output buffer stage and the display panel. The power-saving circuit collects charges from an equivalent load capacitors of each of the data lines, before the output buffer stage drives the first and second data lines through the positive and negative output channels. The power-saving circuit charges one of the positive supply and the negative supply in response to the collected charges, during the output buffer stage drives the first and second data lines through the positive and negative output channels.

In an exemplary embodiment of the invention, under the condition that the power-saving circuit has the ability to charge one of the positive supply and the negative supply, the power-saving circuit may include a first through eighth switches and a flying capacitor. A first terminal of the first switch is coupled to the first data line. A first terminal of the flying capacitor is coupled to a second terminal of the first switch. A first terminal of the second switch is coupled to a second terminal of the flying capacitor, and a second terminal of the second switch is coupled to the second data line. A first terminal of the third switch is coupled to the first data line, and a second terminal of the third switch is coupled to the ground potential. A first terminal of the fourth switch is coupled to the second data line, and a second terminal of the fourth switch is coupled to the ground potential. A first terminal of the fifth switch is coupled to the first terminal of the flying capacitor, and a second terminal of the fifth switch is coupled to the positive supply. A first terminal of the sixth switch is coupled to the first terminal of the flying capacitor, and a second terminal of the sixth switch is coupled to the ground potential. A first terminal of the seventh switch is coupled to the second terminal of the flying capacitor, and a second terminal of the seventh switch is coupled to the ground potential. A first terminal of the eighth switch is coupled to the second terminal of the flying capacitor, and a second terminal of the eighth switch is coupled to the negative supply.

In an exemplary embodiment of the invention, under the condition that the power-saving circuit has the ability to charge one of the positive supply and the negative supply, before the output buffer stage drives the first and second data lines through the positive and negative output channels, and when the first and second switches are turned on and the third through eighth switches are turned off, the flying capacitor collects a part of the charges from the equivalent load capacitors of the first and second data lines, wherein the voltage difference between the two terminals of the flying capacitor is greater than an absolute value of the positive supply, or is greater than an absolute value of the negative supply. When the third and fourth switches are turned on and the first, second and fifth through eighth switches are turned off, the residual charges from the equivalent load capacitors of the first and second data lines are completely released to the ground potential. When the positive supply is to be charged, the fifth and seventh switches are turned on, and the first though fourth switches and the sixth through eighth switches are turned off. When the negative supply is to be charged, the sixth and eighth switches are turned on, and the first through fifth switches and the seventh switch are turned off.

In an exemplary embodiment of the invention, under the condition that the power-saving circuit (only) has the ability to charge the negative supply, the power-saving circuit may include a first through sixth switches and a flying capacitor. A first terminal of the first switch is coupled to the first data line. A first terminal of the flying capacitor is coupled to a second terminal of the first switch. A first terminal of the second switch is coupled to a second terminal of the flying capacitor, and a second terminal of the second switch is coupled to the ground potential. A first terminal of the third switch is coupled to the first data line, and a second terminal of the third switch is coupled to the ground potential. A first terminal of the fourth switch is coupled to the second data line, and a second terminal of the fourth switch is coupled to the ground potential. A first terminal of the fifth switch is coupled to the first terminal of the flying capacitor, and a second terminal of the fifth switch is coupled to the second data line. A first terminal of the sixth switch is coupled to the second terminal of the flying capacitor, and a second terminal of the sixth switch is coupled to the negative supply.

In an exemplary embodiment of the invention, under the condition that the power-saving circuit (only) has the ability to charge the negative supply, before the output buffer stage drives the first and second data lines through the positive and negative output channels, and when the first and second switches are turned on and the third through sixth switches are turned off, the flying capacitor collects a part of the charges from the equivalent load capacitor of the first data line, wherein the voltage difference between the two terminals of the flying capacitor is half of the absolute value of the negative supply. When the third and fourth switches are turned on and the first, second, fifth and sixth switches are turned off, the residual charges from the equivalent load capacitors of the first and second data lines are completely released to the ground potential. When the negative supply is to be charged, the fifth and sixth switches are turned on, and the first through fourth switches are turned off.

In an exemplary embodiment of the invention, under the condition that the power-saving circuit (only) has the ability to charge the positive supply, the power-saving circuit may include a first through sixth switches and a flying capacitor. A first terminal of the first switch is coupled to the second data line. A first terminal of the flying capacitor is coupled to a second terminal of the first switch. A first terminal of the second switch is coupled to a second terminal of the flying capacitor, and a second terminal of the second switch is coupled to the ground potential. A first terminal of the third switch is coupled to the first data line, and a second terminal of the third switch is coupled to the ground potential. A first terminal of the fourth switch is coupled to the second data line, and a second terminal of the fourth switch is coupled to the ground potential. A first terminal of the fifth switch is coupled to the first terminal of the flying capacitor, and a second terminal of the fifth switch is coupled to the first data line. A first terminal of the sixth switch is coupled to the second terminal of the flying capacitor, and a second terminal of the sixth switch is coupled to the positive supply.

In an exemplary embodiment of the invention, under the condition that the power-saving circuit (only) has the ability to charge the positive supply, before the output buffer stage drives the first and second data lines through the positive and negative output channels, and when the first and second switches are turned on and the third through sixth switches are turned off, the flying capacitor collects a part of the charges from the equivalent load capacitor of the second data line, wherein the voltage difference between the two terminals of the flying capacitor is half of the absolute value of the positive supply. When the third and fourth switches are turned on and the first, second, fifth and sixth switches are turned off, the residual charges from the equivalent load capacitors of the first and second data lines are completely released to the ground potential. When the positive supply is to be charged, the fifth and sixth switches are turned on, and the first through fourth switches are turned off.

According to the above descriptions, in the invention, before each of the data lines in the display panel is driven, the charges from the equivalent load capacitors of the data lines may be firstly collected by the flying capacitor in the power-saving circuit, and then the residual charges from the equivalent load capacitors of the data lines are released to the ground potential. On the other hand, the collected charges may be applied to (over)charge one of the positive and negative supplies of the output buffer stage, during each of the data lines in the display panel is driven. In this way, the source driving apparatus may have the power saving mechanism, based on the behaviour/method for (over)charging one of the positive and negative supplies of the output buffer stage through the collected charges.

It should be understood that both the foregoing general description and the following detailed description are exemplary, and are intended to provide further explanation of the invention as claimed without limiting the scope or the spirit of the invention.

BRIEF DESCRIPTION OF THE DRAWINGS

The accompanying drawings are included to provide a further understanding of the embodiments of invention, and are incorporated in and constitute a part of this specification. The drawings illustrate embodiments of the invention and, together with the description, serve to explain the principles of the invention.

DESCRIPTION OF THE EMBODIMENTS

Figure 1:
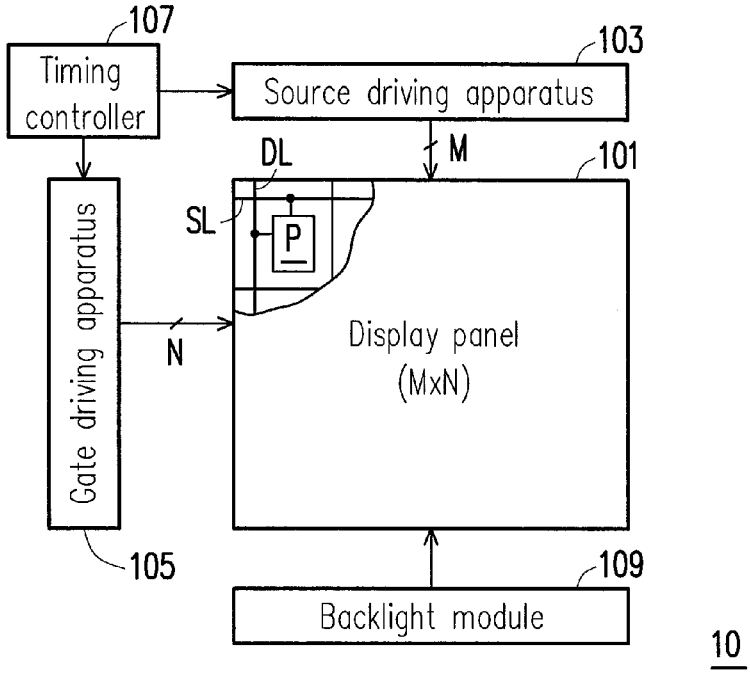
FIG. 1 is a system block diagram of a flat panel display 10 according to an exemplary embodiment of the invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a system block diagram of a flat panel display 10 according to an exemplary embodiment of the invention. Referring to FIG. 1, the flat panel display 10 may be, for example, a liquid crystal display (LCD), but the invention is not limited thereto. Accordingly, the flat panel display 10 may include a (liquid crystal) display panel 101, a source driving apparatus 103, a gate driving apparatus 105, a timing controller (T-con) 107 and a backlight module 109.

In the exemplary embodiment, the display panel 101 has a plurality of data lines DL disposed vertically, a plurality of scan lines SL disposed horizontally and a plurality of pixels P arranged in array which is represented in M*N in FIG. 1, where M and N are both positive integers. It should be noted that, since the liquid crystal display panel 101 itself is not a self-luminous display, the backlight module 109 has to provide a light source (i.e. a backlight source) to the display panel 101, wherein the backlight module 109 may be cold cathode fluorescent lamp (CCFL) backlight module or a light emitting diode (LED) backlight module.

The timing controller 107 is coupled to the source driving apparatus 103 and the gate driving apparatus 105, and is configured to control the overall operation of the source driving apparatus 103 and the gate driving apparatus 105. In other words, the gate driving apparatus 105 is controlled by the timing controller 107, and sequentially generates scan signals so as to drive all the scan lines SL one-by-one in the (liquid crystal) display panel 101, that is, to turn on all the rows of pixels one-by-one in the display panel 101. Moreover, the source driving apparatus 103 is controlled by the timing controller 107, and is configured to provide/generate corresponding data voltages for the rows of pixels being turned on by the gate driving apparatus 105.

In brief, under the control of the timing controller 107, the source driving apparatus 103 may coordinate with the scan signals sequentially generated by the gate driving apparatus 105 to complete data-writing for all the pixels P in the display panel 101. In this way, the (liquid crystal) display panel 101 is capable of displaying image frames, with the light source (backlight) provided by the backlight module 109.

In the exemplary embodiment, the source driving apparatus 103 may drive all the pixels P in the display panel 101 by a driving method such as a dot polarity inversion, a column polarity inversion, a row polarity inversion or a frame polarity inversion in response to the control of the timing controller 107, so as to prevent liquid crystal molecules of each of the pixels P in the (liquid crystal) display panel 101 being deteriorated. Under such condition, the source driving apparatus 103 may be any type of source drives/chips that are applied to a positive/negative structure cooperated with a direct current common voltage (DC Vcom).

Figure 2:
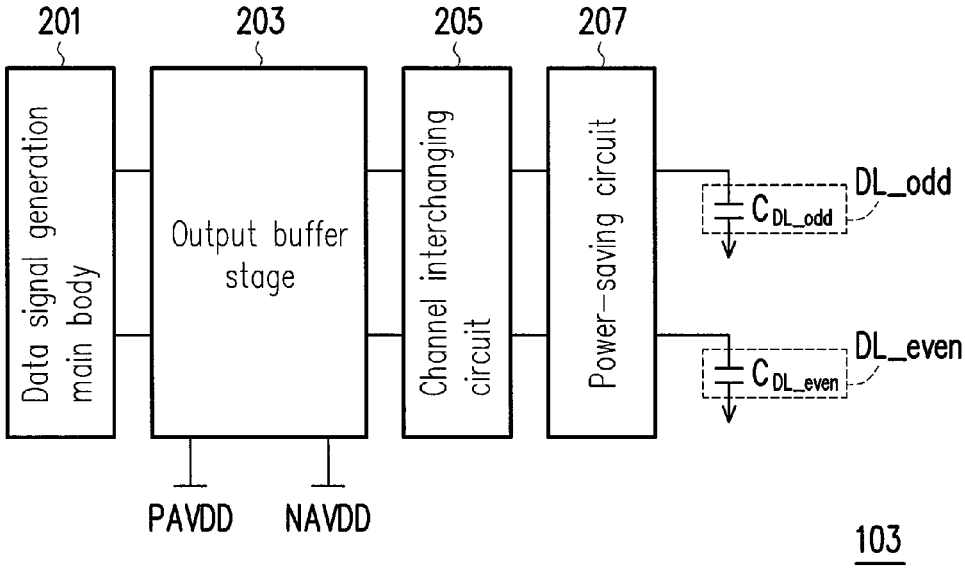
FIG. 2 is a diagram of two adjacent odd and even data lines DL_odd, DL_even of a display panel 101 corresponding to a source driving apparatus 103 in FIG. 1.

Herein, in order to illustrate the operation method of the source driving apparatus 103, FIG. 2 is a diagram of two adjacent odd and even data lines DL_odd, DL_even of a display panel 101 corresponding to the source driving apparatus 103 in FIG. 1. The two data lines DL_odd, DL_even are, namely, an $i^{th}$ and $i+1^{th}$ data lines, where i is an odd positive integer.

Figure 3:
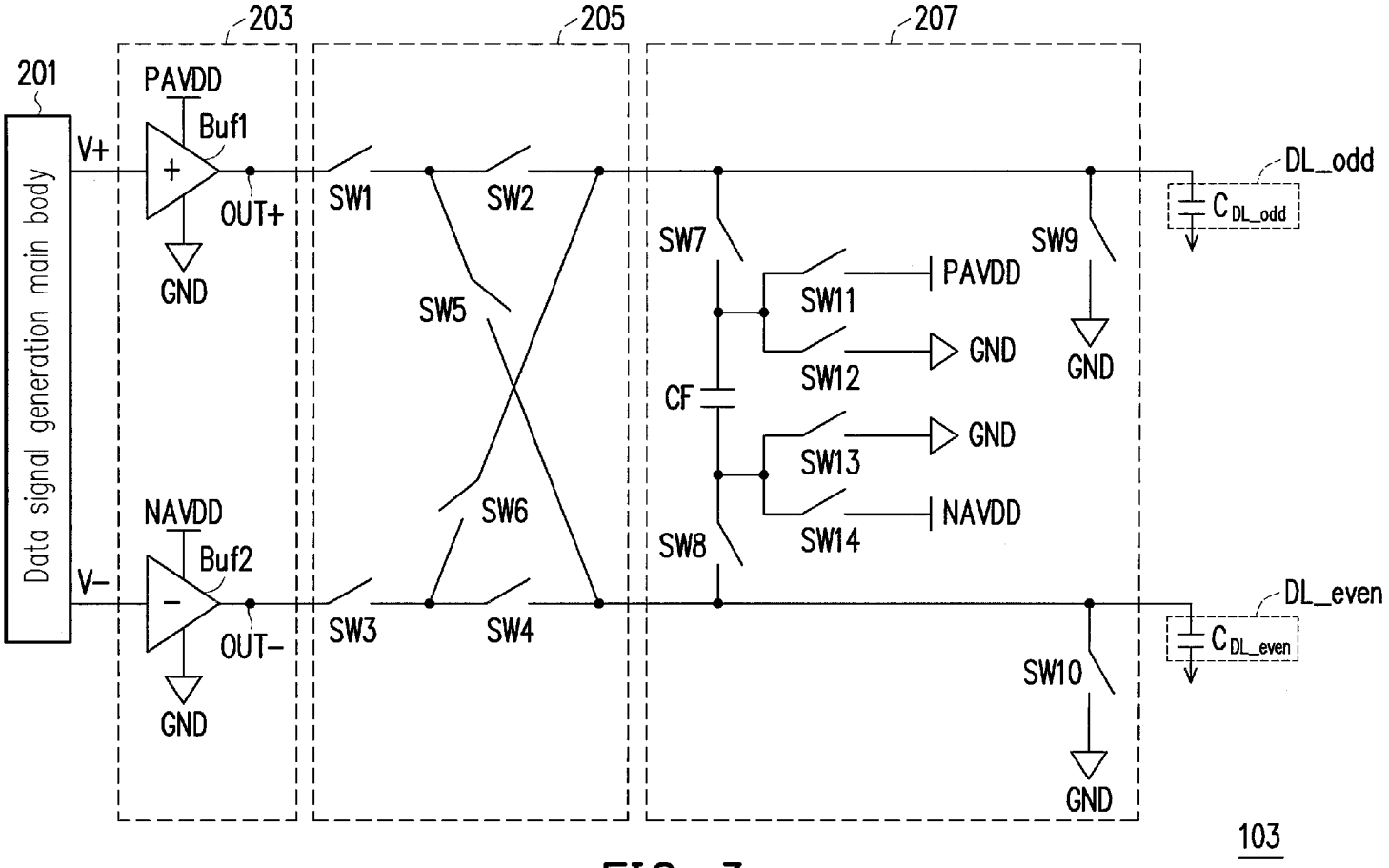
FIG. 3 is an implementation diagram of the source driving apparatus 103 in FIG. 2.

Moreover, FIG. 3 is an implementation diagram of the source driving apparatus 103 in FIG. 2. The source driving apparatus 103 includes a data signal generation main body 201, an output buffer stage 203 operated under the positive and negative supplies (PAVDD, NAVDD) (i.e. dual power), a channel interchanging circuit 205 and a power-saving circuit 207.

In the exemplary embodiment, the data signal generation main body 201 generates a positive and negative data voltages V+, V− respectively corresponding to the data lines DL_odd, DL_even in response to the control of the timing controller 107, wherein the data signal generation main body 201 may be composed by a shift register, a data register, a level shifter and a digital-to-analog converter (ADC), which are not shown in the figures. However, the invention is not limited thereto.

To be specific, the so-called "positive data voltage V+" is a particular data/gray-level voltage greater than the direct current common voltage (DC Vcom) of the liquid crystal display panel 101, and the so-called "negative data voltage V−" is a particular data/gray-level voltage less than the direct current common voltage (DC Vcom) of the liquid crystal display panel 101.

The output buffer stage 203 is coupled to the data signal generation main body 201, and has a positive output channel OUT+ and a negative output channel OUT−. More specifically, the output buffer stage 203 includes buffers Buf1, Buff2, wherein the buffer Buf1 operates under the positive supply PAVDD and a ground potential GND (i.e., a zero potential), and corresponds to the positive output channel OUT+, and the buffer Buf2 operates under the negative supply NAVDD and the ground potential GND, and corresponds to the negative output channel OUT−.

The channel interchanging circuit 205 is coupled between the output buffer stage 203 and the power-saving circuit 207, and alternately varies the connection relations between the output channels OUT+, OUT− and the data lines DL_odd, DL_even based on the reason/requirement of the polarity inversion. In other words, the data line DL_odd may be coupled to one of the output channels OUT+, OUT− through the channel interchanging circuit 205, moreover, the data line DL_even may be coupled to another (the other) one of the output channels OUT+, OUT− through the channel interchanging circuit 205.

More specifically, the channel interchanging circuit 205 may include switches SW1-SW6. A first terminal of the switch SW1 is coupled to an output of the buffer Buf1 (i.e., the output channel OUT+). A first terminal of the switch SW2 is coupled to a second terminal of the switch SW1, and a second terminal of the switch SW2 is coupled to the data line DL_odd. A first terminal of the switch SW3 is coupled to an output of the buffer Buf2 (i.e., the output channel OUT−). A first terminal of the switch SW4 is coupled to a second terminal of the switch SW3, and a second terminal of the switch SW4 is coupled to the data line DL_even. A first terminal of the switch SW5 is coupled to the second terminal of the switch SW1, and a second terminal of the switch SW5 is coupled to the data line DL_even. A first terminal of the switch SW6 is coupled to the second terminal of the switch SW3, and a second terminal of the switch SW6 is coupled to the data line DL_odd.

The power-saving circuit 207 is coupled between the output buffer stage 203 and the display panel 101 via the channel interchanging circuit 205. The power-saving circuit 207 collects charges from equivalent load capacitors $C_{DL_odd}$, $C_{DL_even}$ of the data lines DL_odd, DL_even before the output buffer stage 203 drives the data lines DL_odd, DL_even through the output channels OUT+, OUT−, and the power-saving circuit 207 (over)charges one of the positive and negative supplies PAVDD, NAVDD in response to the collected charges during the output buffer stage 203 drives the data lines DL_odd, DL_even through the output channels OUT+, OUT−.

To be specific, the power-saving circuit 207 has the ability to charge one of the positive and negative supplies PAVDD, NAVDD. The power-saving circuit 207 includes switches SW7-SW14 and a flying capacitor CF. A first terminal of the switch SW7 is coupled to the data line DL_odd. A first terminal of the flying capacitor CF is coupled to a second terminal of the switch SW7. A first terminal of the switch SW8 is coupled to a second terminal of the flying capacitor CF, and a second terminal of the switch SW8 is coupled to the data line DL_even. A first terminal of the switch SW9 is coupled to the data line DL_odd, and a second terminal of the switch SW9 is coupled the ground potential GND. A first terminal of the switch SW10 is coupled to the data line DL_even, and a second terminal of the switch SW10 is coupled to the ground potential GND.

A first terminal of the switch SW11 is coupled the first terminal of the flying capacitor CF, and a second terminal of the switch SW11 is coupled to the positive supply PAVDD. A first terminal of the switch SW12 is coupled to the first terminal of the flying capacitor CF, and a second terminal of the switch SW12 is coupled to the ground potential GND. A first terminal of the switch SW13 is coupled to the second terminal of the flying capacitor CF, and a second terminal of the switch SW13 is coupled to the ground potential GND. A first terminal of the switch SW14 is coupled to the second terminal of the flying capacitor CF, and a second terminal of the switch SW14 is coupled to the negative supply NAVDD.

In view of the foregoing, initially, the positive output channel OUT+ corresponds to the data line DL_odd, and the negative output channel OUT− corresponds to the data line DL_even. Therefore, the data signal generation main body 201 may respectively generate the positive data voltage V+ and the negative data voltage V− relative to the direct current common voltage (DC Vcom) of the liquid crystal display panel 101 to the data lines DL_odd, DL_even in response to the control of the timing controller 107. Under such condition, the switches SW1-SW4 may be turned on, and the rest of the switches SW5-SW14 may be turned off.

On the other hand, under the condition that the source driving apparatus 103 is to be performed the polarity inversion, only the switches SW7, SW8 are turned on, and the rest of the switches SW1-SW6, SW8-SW14 are turned off in response to the control of the timing controller 107. In this way, the flying capacitor CF may collect a part of the previously stored positive charges from the equivalent load capacitor $C_{DL_odd}$ of the data line DL_odd and a part of the previously stored negative charges from the equivalent load capacitor $C_{DL_even}$ of the data line DL_even. Here, in the exemplary embodiment, it is assumed that the voltage difference between the two terminals of the flying capacitor CF is greater than an absolute value of the positive supply PAVDD (i.e., |PAVDD|), or is greater than an absolute value of the negative supply NAVDD (i.e., |NAVDD|).

After the flying capacitor CF collects the charges from the equivalent load capacitors $C_{DL_odd}$, $C_{DL_even}$ of the data lines DL_odd, DL_even, only the switches SW9, SW10 are turned on, and the rest of the switches SW1-SW8, SW11-SW14 are turned off in response to the control of the timing controller 107. In this way, the residual charges from the equivalent load capacitors $C_{DL_odd}$, $C_{DL_even}$ of the data lines DL_odd, DL_even may be completely released to the ground (i.e., the ground potential GND). Namely, each of the data lines DL_odd, DL_even here corresponds to the zero potential (0V).

After the residual charges from the equivalent load capacitors $C_{DL_odd}$, $C_{DL_even}$ of the data lines DL_odd, DL_even are released to the ground, the source driving apparatus 103 may perform the polarity inversion. Under such condition, it is assumed that now the positive supply PAVDD is to be (over)charged, the data signal generation main body 201 may respectively generate another positive data voltage V+ and another negative data voltage V− relative to the direct current common voltage (DC Vcom) of the (liquid crystal) display panel 101 to the data lines DL_odd, DL_even in response to the control of the timing controller 107. Accordingly, the switches SW1, SW3, SW5, SW6, SW11 and SW13 are turned on, and the rest of the switches SW2, SW4, SW7-SW10, SW12 and SW14 are turned off. Here, based on the capacitance coupling effect caused by the flying capacitor CF, the charges previously stored in the flying capacitor CF may (over)charge the positive supply PAVDD (i.e., higher than the original level of the positive supply PAVDD). According to the foregoing, the source driving apparatus 103 may have the power saving mechanism based on the behaviour/method that the collected charges (over)charge the positive supply PAVDD.

On the other hand, after the residual charges from the equivalent load capacitors $C_{DL_odd}$, $C_{DL_even}$ of the data lines DL_odd, DL_even are released to the ground, the source driving apparatus 103 may perform the polarity inversion. Under such condition, it is assumed that now the negative supply NAVDD is to be (over)charged, the data signal generation main body 201 may respectively generate another positive data voltage V+ and another negative data voltage V− relative to the direct current common voltage (DC Vcom) of the (liquid crystal) display panel 101 to the data lines DL_odd, DL_even in response to the control of the timing controller 107. Accordingly, the switches SW1, SW3, SW5, SW6, SW12 and SW14 are turned on, and the rest of the switches SW2, SW4, SW7-SW11 and SW13 are turned off. Here, based on the capacitance coupling effect triggered by the flying capacitor CF, the charges previously stored in the flying capacitor CF may (over)charge the negative supply NAVDD (i.e., lower than the original level of the negative supply NAVDD). According to the foregoing, the source driving apparatus 103 may have the power saving mechanism based on the behaviour/method that the collected charges (over)charge the negative supply NAVDD.

Figure 4:
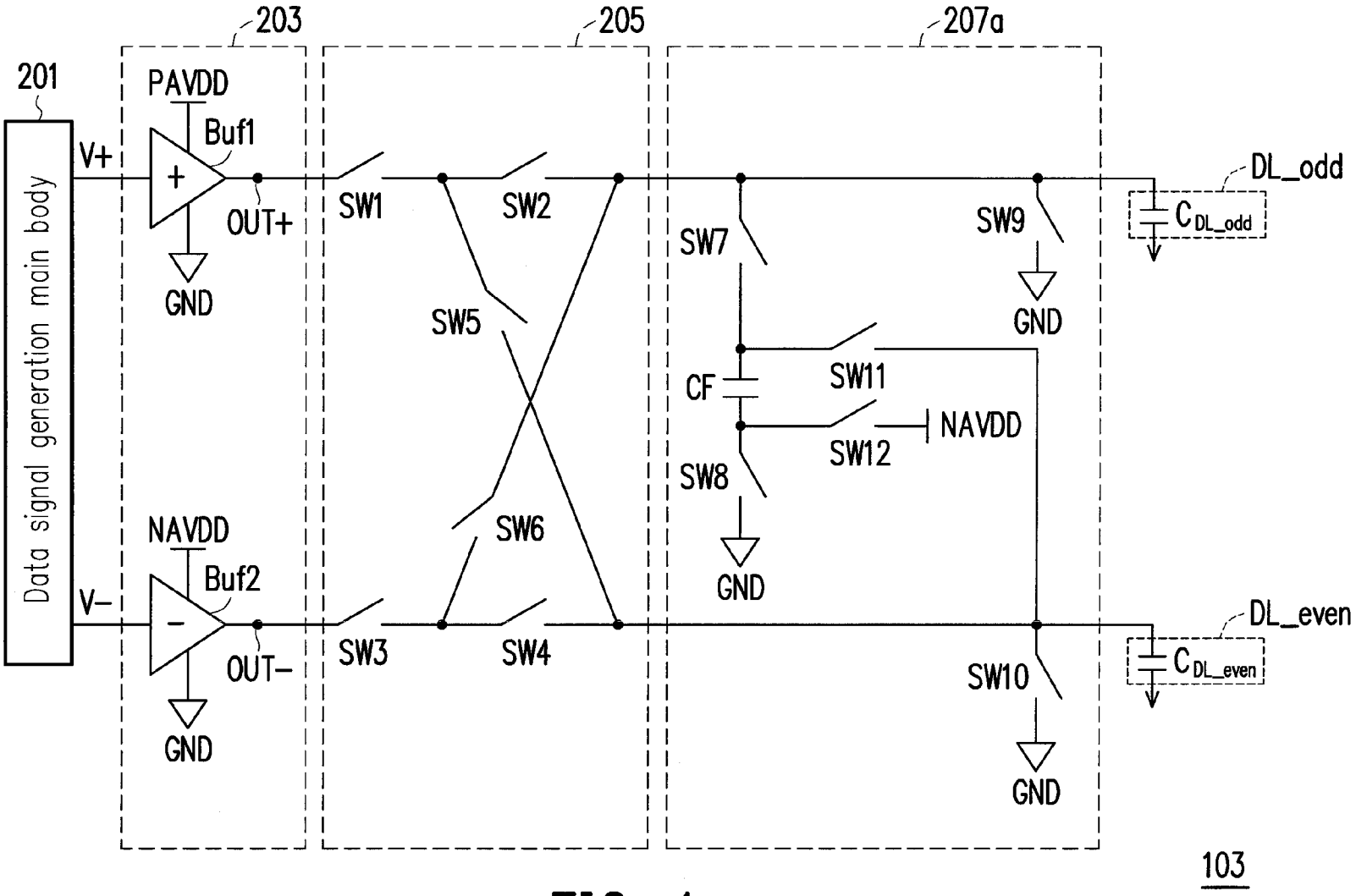
FIG. 4 is another implementation diagram of the source driving apparatus 103 in FIG. 2.

On the other hand, FIG. 4 is another implementation diagram of the source driving apparatus 103 in FIG. 2. Referring to FIG. 3 and FIG. 4 together, the only difference is: the power-saving circuit 207*a* shown in FIG. 4 may (only) have the ability to (over)charge the negative supply NAVDD. Under such condition, the power-saving circuit 207*a* shown in FIG. 4 includes the switches SW7-SW12 and the flying capacitor CF.

As shown in FIG. 4, the first terminal of the switch SW7 is coupled to the data line DL_odd. The first terminal of the flying capacitor CF is coupled to the second terminal of the switch SW7. The first terminal of the switch SW8 is coupled to the second terminal of the flying capacitor CF, and the second terminal of the switch SW8 is coupled to the ground potential GND. The first terminal of the switch SW9 is coupled to the data line DL_odd, and the second terminal of the switch SW9 is coupled the ground potential GND. The first terminal of the switch SW10 is coupled to the data line DL_even, and the second terminal of the switch SW10 is coupled to the ground potential GND. The first terminal of the switch SW11 is coupled the first terminal of the flying capacitor CF, and the second terminal of the switch SW11 is coupled to the data line DL_even. The first terminal of the switch SW12 is coupled to the second terminal of the flying capacitor CF, and the second terminal of the switch SW12 is coupled to the negative supply NAVDD.

With the implementation pattern shown in FIG. 4 and under the initial conditions that the positive output channel OUT+ corresponds to the data line DL_even and the negative output channel OUT− corresponds to the data line DL_odd, the data signal generation main body 201 may respectively generate the positive data voltage V+ and the negative data voltage V− relative to the direct current common voltage (DC Vcom) of the display panel 101 to the data lines DL_even, DL_odd in response to the control of the timing controller 107. Under such condition, the switches SW1, SW3, SW5 and SW6 are turned on, and the rest of the switches SW2, SW4 and SW7-SW12 are turned off.

On the other hand, under the activity condition that the source driving apparatus 103 is to be performed the polarity inversion, only the switches SW7, SW8 are turned on, and the rest of the switches SW1-SW6, SW9-SW12 are turned off in response to the control of the timing controller 107. In this way, the flying capacitor CF may collect a part of the previously stored negative charges from the equivalent load capacitor $C_{DL_odd}$ of the data line DL_odd. Here, in the exemplary embodiment, it is assumed that the voltage difference between the two terminals of the flying capacitor CF is half of the absolute value of the negative supply NAVDD (i.e., ½*|NAVDD|).

After the flying capacitor CF collects the charges from the equivalent load capacitor $C_{DL_odd}$ of the data line DL_odd, only the switches SW9, SW10 are turned on, and the rest of the switches SW1-SW8, SW11-SW14 are turned off in response to the control of the timing controller 107. In this way, the residual charges from the equivalent load capacitors $C_{DL_odd}$, $C_{DL_even}$ of the data lines DL_odd, DL_even are completely released to the ground (i.e., the ground potential GND).

After the residual charges from the equivalent load capacitors $C_{DL_odd}$, $C_{DL_even}$ of the data lines DL_odd, DL_even are released to the ground, the source driving apparatus 103 may perform the polarity inversion. Under such condition, the data signal generation main body 201 may respectively generate another positive data voltage V+ and another negative data voltage V− relative to the direct current common voltage (DC Vcom) of the (liquid crystal) display panel 101 to the data lines DL_even, DL_odd in response to the control of the timing controller 107. Accordingly, the switches SW1-SW4, SW11 and SW12 are turned on, and the rest of the switches SW7-SW10 are turned off. Here, based on the previous voltage difference between the two terminals of the flying capacitor CF is ½*|NAVDD|, hence, the charges previously stored in the flying capacitor CF may (over)charge the negative supply NAVDD (i.e., lower than the original level of the negative supply NAVDD), only when the voltage on the equivalent load capacitor $C_{DL_even}$ of the data line DL_even is lower than −½*|NAVDD|. According to the foregoing, the source driving apparatus 103 may have the power saving mechanism based on the behaviour/method that the collected charges (over)charge the negative supply NAVDD.

Figure 5:
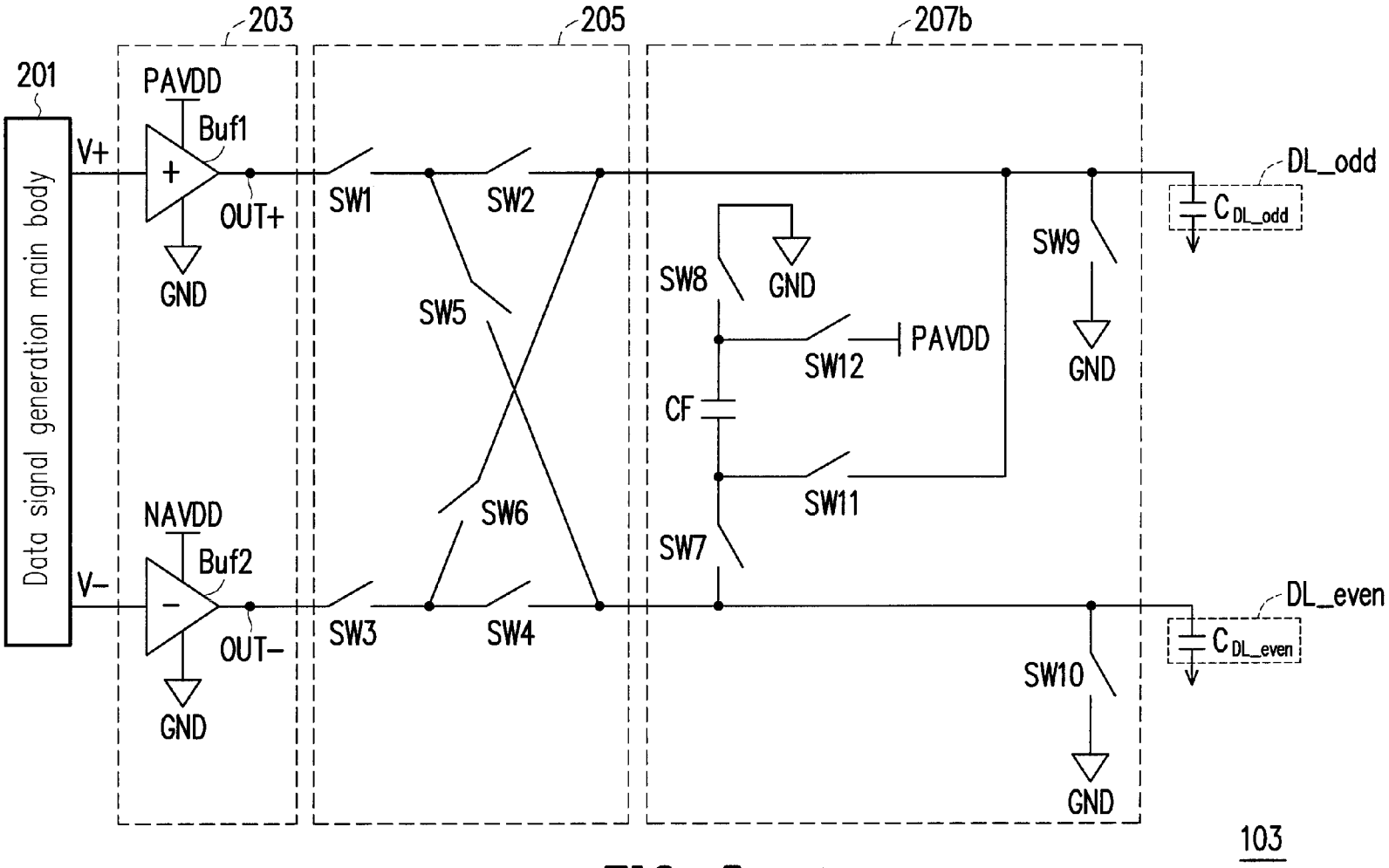
FIG. 5 is another implementation diagram of the source driving apparatus 103 in FIG. 2.

On the other hand, FIG. 5 is another implementation diagram of the source driving apparatus 103 in FIG. 2. Referring to FIG. 3 and FIG. 5, the only difference is the power-saving circuit 207*b* shown in FIG. 5 may (only) have the ability to (over)charge the positive supply PAVDD. Under such condition, the power-saving circuit 207*b* shown in FIG. 5 includes the switches SW7-SW12 and the flying capacitor CF.

As shown in FIG. 5, the first terminal of the switch SW7 is coupled to the data line DL_even. The first terminal of the flying capacitor CF is coupled to the second terminal of the switch SW7. The first terminal of the switch SW8 is coupled to the second terminal of the flying capacitor CF, and the second terminal of the switch SW8 is coupled to the ground potential GND. The first terminal of the switch SW9 is coupled to the data line DL_odd, and the second terminal of the switch SW9 is coupled the ground potential GND. The first terminal of the switch SW10 is coupled to the data line DL_even, and the second terminal of the switch SW10 is coupled to the ground potential GND. The first terminal of the switch SW11 is coupled the first terminal of the flying capacitor CF, and the second terminal of the switch SW11 is coupled to the data line DL_odd. The first terminal of the switch SW12 is coupled to the second terminal of the flying capacitor CF, and the second terminal of the switch SW12 is coupled to the positive supply PAVDD.

With the implementation pattern shown in FIG. 5 and under the initial conditions that the positive output channel OUT+ corresponds to the data line DL_even and the negative output channel OUT− corresponds to the data line DL_odd, the data signal generation main body 201 may respectively generate the positive data voltage V+ and the negative data voltage V− relative to the direct current common voltage (DC Vcom) of the display panel 101 to the data lines DL_even, DL_odd in response to the control of the timing controller 107. Under such condition, the switches SW1, SW3, SW5 and SW6 are turned on, and the rest of the switches SW2, SW4 and SW7-SW12 are turned off.

On the other hand, under the activity condition that the source driving apparatus 103 is to be performed the polarity inversion, only the switches SW7, SW8 are turned on, and the rest of the switches SW1-SW6, SW9-SW12 are turned off in response to the control of the timing controller 107. In this way, the flying capacitor CF may collect a part of the previously stored positive charges from the equivalent load capacitor $C_{DL_even}$ of the data line DL_even. Here, in the exemplary embodiment, it is assumed that the voltage difference between the two terminals of the flying capacitor CF is half of the absolute value of the positive supply PAVDD (i.e., ½*|PAVDD|).

After the flying capacitor CF collects the charges from the equivalent load capacitor $C_{DL_even}$ of the data line DL_even, only the switches SW9, SW10 are turned on, and the rest of the switches SW1-SW8, SW11-SW14 are turned off in response to the control of the timing controller 107. In this way, the residual charges from the equivalent load capacitors $C_{DL_odd}$, $C_{DL_even}$ of the data lines DL_odd, DL_even are completely released to the ground (i.e., the ground potential GND). In other words, each of the data lines DL_odd, DL_even here corresponds to the zero potential (0V).

After the residual charges from the equivalent load capacitors $C_{DL_odd}$, $C_{DL_even}$ of the data lines DL_odd, DL_even are released to the ground, the source driving apparatus 103 may perform the polarity inversion. Under such condition, the data signal generation main body 201 may respectively generate another positive data voltage V+ and another negative data voltage V− relative to the direct current common voltage (DC Vcom) of the (liquid crystal) display panel 101 to the data lines DL_even, DL_odd in response to the control of the timing controller 107. Accordingly, the switches SW1-SW4, SW11 and SW12 are turned on, and the rest of the switches SW7-SW10 are turned off. Here, based on the previous voltage difference between the two terminals of the flying capacitor CF is ½*|PAVDD|, hence, the charges previously stored in the flying capacitor CF may (over)charge the positive supply PAVDD (i.e., higher than the original level of the positive supply PAVDD), only when the voltage on the equivalent load capacitor $C_{DL_odd}$ of the data line DL_odd is higher than ½*|PAVDD|. According to the foregoing, the source driving apparatus 103 may have the power saving mechanism based on the behaviour/method that the collected charges (over) charge the positive supply PAVDD.

To sum up, in the invention, before each of the data lines in the display panel is driven, the charges from the equivalent load capacitors of the data lines may be firstly collected by the flying capacitor in the power-saving circuit, and then the residual charges from the equivalent load capacitors of the data lines may be released to the ground. On the other hand, the collected charges may be applied to (over)charge one of the positive and negative supplies of the output buffer stage, during each of the data lines in the display panel is driven. In this way, the source driving apparatus may achieve the effect of power saving, based on the behaviour/method for (over) charging one of the positive and negative supplies of the output buffer stage through the collected charges.

It should be noted that, the collected charges are applied to (over)charge one of the positive and negative supplies of the output buffer stage, during the flying capacitor in the power-saving circuit collects the charges from the equivalent load capacitors of the data lines so as to drive each of the data lines in the display panel. Thus, utilizing the power-saving circuit designed by the flying capacitor and the switches may not affect the original data voltage(s) to be provided by the source driving apparatus, and may further apply the charges from the equivalent load capacitors of the data lines effectively to increase the power-saving effect of the source driving apparatus.

What is claimed is:

1. A source driving apparatus, adapted to a display panel, comprising:

an output buffer stage, having a positive output channel and a negative output channel respectively coupled to a first data line and a second data line of the display panel, wherein the output buffer stage operates under a positive supply and a negative supply; and a power-saving circuit, coupled between the output buffer stage and the display panel, for collecting charges from equivalent load capacitors of the first data line and the second data line before the output buffer stage drives the first data line and the second data line through the output channels, and charging one of the positive supply and the negative supply in response to the collected charges during the output buffer stage drives the first data line and the second data line through the output channels.

2. The source driving apparatus as claimed in claim 1, wherein the output buffer stage comprises:

a first buffer, corresponding to the positive output channel and operating under the positive supply and a ground potential; and a second buffer, corresponding to the negative output channel and operating under the negative supply and the ground potential.

3. The source driving apparatus as claimed in claim 2, further comprising:

a channel interchanging circuit, coupled between the output buffer stage and the power-saving circuit, and configured to alternately vary the connections between the positive and negative output channels and the first and second data lines, wherein the first data line is coupled to one of the positive output channel and the negative output channel through the channel interchanging circuit, otherwise the second data line is coupled to the other one of the positive output channel and the negative output channel through the channel interchanging circuit.

4. The source driving apparatus as claimed in claim 3, wherein the channel interchanging circuit comprises:

a first switch, having a first terminal coupled to an output of the first buffer;

a second switch, having a first terminal coupled to a second terminal of the first switch, and a second terminal coupled to the first data line;

a third switch, having a first terminal coupled to an output of the second buffer;

a fourth switch, having a first terminal coupled to a second terminal of the third switch, and a second terminal coupled to the second data line;

a fifth switch, having a first terminal coupled to the second terminal of the first switch, and a second terminal coupled to the second data line; and a sixth switch, having a first terminal coupled to the second terminal of the third switch, and a second terminal coupled to the first data line.

5. The source driving apparatus as claimed in claim 4, wherein:

when the positive output channel corresponds to the first data line and the negative output channel corresponds to the second data line, the first through fourth switches are turned on, and the fifth and sixth switches are turned off; and when the positive output channel corresponds to the second data line and the negative output channel corresponds to the first data line, the first, third, fifth and sixth switches are turned on, and the second and fourth switches are turned off.

6. The source driving apparatus as claimed in claim 2, wherein the power-saving circuit comprises:

a first switch, having a first terminal coupled to the first data line;

a flying capacitor, having a first terminal coupled to a second terminal of the first switch;

a second switch, having a first terminal coupled to a second terminal of the flying capacitor, and a second terminal coupled to the second data line;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the positive supply;

a sixth switch, having a first terminal coupled to the first terminal of the flying capacitor, and a second terminal coupled to the ground potential;

a seventh switch, having a first terminal coupled to the second terminal of the flying capacitor, and a second terminal coupled to the ground potential; and an eighth switch, having a first terminal coupled to the second terminal of the flying capacitor, and a second terminal coupled to the negative supply.

7. The source driving apparatus as claimed in claim 6, wherein before the output buffer stage drives the first data line and the second data line through the output channels, during the first and second switches are turned on and the third through eighth switches are turned off, the flying capacitor collects a part of the charges from the equivalent load capacitors of the first data line and the second data line, wherein a voltage difference between the first and second terminals of the flying capacitor is greater than an absolute value of the positive supply, or is greater than an absolute value of the negative supply;

during the third and fourth switches are turned on and the first, second and fifth through eighth switches are turned off, residual charges from the equivalent load capacitors of the first data line and the second data line are completely released to the ground potential;

during the positive supply is to be charged, the fifth and seventh switches are turned on, and the first though fourth switches and the sixth through eighth switches are turned off; and during the negative supply is to be charged, the sixth and eighth switches are turned on, and the first through fifth switches and the seventh switch are turned off.

8. The source driving apparatus as claimed in claim 2, wherein the power-saving circuit comprises:

a first switch, having a first terminal coupled to the first data line;

a flying capacitor, having a first terminal coupled to a second terminal of the first switch;

a second switch, having a first terminal coupled to a second terminal of the flying capacitor, and a second terminal coupled to the ground potential;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the second data line; and a sixth switch, having a first terminal coupled to the second terminal of the flying capacitor, and a second terminal coupled to the negative supply.

9. The source driving apparatus as claimed in claim 8, wherein before the output buffer stage drives the first data line and the second data line through the output channels, during the first and second switches are turned on and the third through sixth switches are turned off, the flying capacitor collects a part of the charges from the equivalent load capacitor of the first data line, wherein a voltage difference between the first and second terminals of the flying capacitor is half of the absolute value of the negative supply;

during the third and fourth switches are turned on and the first, second, fifth and sixth switches are turned off, residual charges from the equivalent load capacitors of the first data line and the second data line are completely released to the ground potential; and during the negative supply is to be charged, the fifth and sixth switches are turned on, and the first through fourth switches are turned off.

10. The source driving apparatus as claimed in claim 2, wherein the power-saving circuit comprises:

a first switch, having a first terminal coupled to the second data line;

a flying capacitor, having a first terminal coupled to a second terminal of the first switch;

a second switch, having a first terminal coupled to a second terminal of the flying capacitor, and a second terminal coupled to the ground potential;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the first data line; and a sixth switch, having a first terminal coupled to the second terminal of the flying capacitor, and a second terminal coupled to the positive supply.

11. The source driving apparatus as claimed in claim 10, wherein before the output buffer stage drives the first data line and the second data line through the output channels, when the first and second switches are turned on and the third through sixth switches are turned off, the flying capacitor collects a part of the charges from the equivalent load capacitor of the second data line, wherein a voltage difference between the first and second terminals of the flying capacitor is half of the absolute value of the positive supply;

when the third and fourth switches are turned on and the first, second, fifth and sixth switches are turned off, residual charges from the equivalent load capacitors of the first data line and the second data line are completely released to the ground potential; and when the positive supply is to be charged, the fifth and sixth switches are turned on, and the first through fourth switches are turned off.

12. A flat panel display, comprising:

a display panel, having a first data line and a second data line; and a source driving apparatus, coupled to the display panel, comprising:

an output buffer stage, having a positive output channel and a negative output channel respectively coupled to the first data line and the second data line; and a power-saving circuit, coupled between the output buffer stage and the display panel, for respectively collecting charges from equivalent load capacitors of the first data line and the second data line before the output buffer stage drives the first data line and the second data line through the output channels, and charging one of the positive supply and the negative supply in response to the collected charges during the output buffer stage drives the first data line and the second data line through the output channels.

13. The flat panel display as claimed in claim 12, wherein the output buffer stage comprises:

a first buffer, corresponding to the positive output channel and operating under the positive supply and a ground potential; and a second buffer, corresponding to the negative output channel and operating under the negative supply and the ground potential.

14. The flat panel display as claimed in claim 13, wherein the source driving apparatus further comprises:

a channel interchanging circuit, coupled between the output buffer stage and the power-saving circuit, and configured to alternately vary the connections between the positive and negative output channels and the first and second data lines, wherein the first data line is coupled to one of the positive output channel and the negative output channel through the channel interchanging circuit, and the second data line is coupled to the other one of the positive output channel and the negative output channel through the channel interchanging circuit.

15. The flat panel display as claimed in claim 14, wherein the channel interchanging circuit comprises:

a first switch, having a first terminal coupled to an output of the first buffer;

a second switch, having a first terminal coupled to a second terminal of the first switch, and a second terminal coupled to the first data line;

a third switch, having a first terminal coupled to an output of the second buffer;

a fourth switch, having a first terminal coupled to a second terminal of the third switch, and a second terminal coupled to the second data line;

a fifth switch, having a first terminal coupled to the second terminal of the first switch, and a second terminal coupled to the second data line; and a sixth switch, having a first terminal coupled to the second terminal of the third switch, and a second terminal coupled to the first data line.

16. The flat panel display as claimed in claim 15, wherein:

when the positive output channel corresponds to the first data line and the negative output channel corresponds to the second data line, the first, second, third and fourth switches are turned on, and the fifth and sixth switches are turned off; and when the positive output channel corresponds to the second data line and the negative output channel corresponds to the first data line, the first, third, fifth and sixth switches are turned on, and the second and fourth switches are turned off.

17. The flat panel display as claimed in claim 12, wherein the power-saving circuit comprises:

a first switch, having a first terminal coupled to the first data line;

a flying capacitor, having a first terminal coupled to a second terminal of the first switch;

a second switch, having a first terminal coupled to a second terminal of the flying capacitor, and a second terminal coupled to the second data line;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the positive supply;

a sixth switch, having a first terminal coupled to the first terminal of the flying capacitor, and a second terminal coupled to the ground potential;

a seventh switch, having a first terminal coupled to the second terminal of the flying capacitor, and a second terminal coupled to the ground potential; and an eighth switch, having a first terminal coupled to the second terminal of the flying capacitor, and a second terminal coupled to the negative supply.

18. The flat panel display as claimed in claim 17, wherein before the output buffer stage drives the first data line and the second data line through the output channels, when the first and second switches are turned on and the third through eighth switches are turned off, the flying capacitor collects a part of the charges from the equivalent load capacitors of the first data line and the second data line, wherein a voltage difference between the first and second terminals of the flying capacitor is greater than an absolute value of the positive supply, or is greater than an absolute value of the negative supply;

when the third and fourth switches are turned on and the first, second and fifth through eighth switches are turned off, residual charges from the equivalent load capacitors of the first data line and the second data line are completely released to the ground potential;

when the positive supply is to be charged, the fifth and seventh switches are turned on, and the first though fourth switches and the sixth through eighth switches are turned off; and when the negative supply is to be charged, the sixth and eighth switches are turned on, and the first through fifth switches and the seventh switch are turned off.

19. The flat panel display as claimed in claim 12, wherein the power-saving circuit comprises:

a first switch, having a first terminal coupled to the first data line;

a flying capacitor, having a first terminal coupled to a second terminal of the first switch;

a second switch, having a first terminal coupled to a second terminal of the flying capacitor, and a second terminal coupled to the ground potential;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the second data line; and a sixth switch, having a first terminal coupled to the second terminal of the flying capacitor, and a second terminal coupled to the negative supply, wherein before the output buffer stage drives the first data line and the second data line through the output channels, wherein when the first and second switches are turned on and the third through sixth switches are turned off, the flying capacitor collects a part of the charges from the equivalent load capacitor of the first data line, wherein a voltage difference between the first and second terminals of the flying capacitor is half of the absolute value of the negative supply, wherein when the third and fourth switches are turned on and the first, second, fifth and sixth switches are turned off, residual charges from the equivalent load capacitors of the first data line and the second data line are completely released to the ground potential, and wherein when the negative supply is to be charged, the fifth and sixth switches are turned on, and the first through fourth switches are turned off.

20. The flat panel display as claimed in claim 12, wherein the power-saving circuit comprises:

a first switch, having a first terminal coupled to the second data line;

a flying capacitor, having a first terminal coupled to a second terminal of the first switch;

a second switch, having a first terminal coupled to a second terminal of the flying capacitor, and a second terminal coupled to the ground potential;

a third switch, having a first terminal coupled to the first data line, and a second terminal coupled to the ground potential;

a fourth switch, having a first terminal coupled to the second data line, and a second terminal coupled to the ground potential;

a fifth switch, having a first terminal coupled to the first terminal of the flying capacitor, and a second terminal coupled to the first data line; and a sixth switch, having a first terminal coupled to the second terminal of the flying capacitor, and a second terminal coupled to the positive supply, wherein before the output buffer stage drives the first data line and the second data line through the output channels, wherein when the first and second switches are turned on and the third through sixth switches are turned off, the flying capacitor collects a part of the charges from the equivalent load capacitor of the second data line, wherein a voltage difference between the first and second terminals of the flying capacitor is half of the absolute value of the positive supply, wherein when the third and fourth switches are turned on and the first, second, fifth and sixth switches are turned off, residual charges from the equivalent load capacitors of the first data line and the second data line are completely released to the ground potential, and wherein when the positive supply is to be charged, the fifth and sixth switches are turned on, and the first through fourth switches are turned off.

* * * * *